United States Patent [19]

Simmons

[11] 4,260,415

[45] Apr. 7, 1981

[54] DECARBURIZING MOLTEN METAL

[75] Inventor: Richard P. Simmons, Sewickley, Pa.

[73] Assignee: Allegheny Ludlum Steel Corporation, Pittsburgh, Pa.

[21] Appl. No.: 102,607

[22] Filed: Dec. 12, 1979

[51] Int. Cl.[3] ..... C21C 5/34

[52] U.S. Cl. ..... 75/60; 75/52; 75/59

[58] Field of Search ..... 75/52, 59, 60

[56] References Cited

U.S. PATENT DOCUMENTS

| | | | |
|---|---|---|---|
| 3,046,107 | 7/1962 | Nelson | 75/59 |
| 3,741,557 | 6/1973 | Harbaugh | 266/35 |
| 3,748,122 | 7/1973 | Ramachandran | 75/60 |
| 3,798,025 | 3/1974 | Ramachandran | 75/60 |
| 3,832,160 | 8/1974 | Bishop | 75/60 |
| 3,850,617 | 11/1974 | Umowski | 75/49 |
| 3,861,888 | 1/1975 | Heise | 75/60 |
| 3,930,843 | 1/1976 | Fruehan | 75/60 |

*Primary Examiner*—P. D. Rosenberg

*Attorney, Agent, or Firm*—Vincent G. Gioia; William J. O'Rourke, Jr.

[57] ABSTRACT

An improved method of refining molten metal is disclosed comprising the steps of injecting a mixture of oxygen and an inert gas below the surface of molten metal at a high oxygen to inert gas ratio while utilizing from about 2.5 to 12% of the injected inert gas to shroud the remainder of the injected gaseous mixture. The oxygen to inert gas ratio is progressively decreased as the carbon content in the molten metal decreases and the temperature of the molten metal increases. The improvement of the present invention comprises supplying dry air to the remainder of the injected gaseous mixture in a quantity sufficient for the nitrogen in the dry air to fulfill the inert gas requirements for the remainder of the injected gaseous mixture, and for the oxygen in the dry air to fulfill at least a portion of the oxygen requirements for the injected gaseous mixture.

12 Claims, No Drawings

DECARBURIZING MOLTEN METAL

SUMMARY OF THE INVENTION

The present invention relates to decarburizing molten metal and, more particularly, to an improved method of refining molten steel by utilizing dry air in order to reduce the requirements for gaseous nitrogen and gaseous oxygen previously supplied from separate gas sources.

In the production of metal, particularly steel, it is standard practice to remove excessive quantities of certain impurities which may be present in the metal. An essential part of present day steel production includes a process called decarburizing. Decarburizing is a process for reducing the amount of carbon present in the metal. This process is generally performed by injecting oxygen into molten steel in a manner which precipitates a reaction between the carbon dissolved in the molten steel and the injected gaseous oxygen to form volatile carbon oxides which may be removed from the molten steel. Various decarburizing processes are disclosed in the prior art including U.S. Pat. Nos. 3,741,557; 3,748,122; 3,798,025 and 3,832,160.

A variant to decarburizing with substantially pure oxygen alone is disclosed in U.S. Pat. Nos. 3,046,107 and 3,252,790. Such alternative process includes the simultaneous introduction of gaseous oxygen and an inert gas into the molten metal in a controlled manner. Such process has the advantage of minimizing chromium and iron oxidation during decarburizing. Although not normally considered to be an inert gas, nitrogen is commonly utilized to provide the majority of the inert gas requirements for such alternative decarburization process.

In practicing the decarburizing process described above, it has been standard practice to install and maintain separate storage facilitates for the gaseous oxygen, the argon, the nitrogen, and other inert gases and to purchase sufficient quantities of the pure gases, oxygen, nitrogen, argon, etc., as may be required. The use of separate storage facilities for the different gases used in the decarburizing process permitted tight control of gas volumes and accurate maintenance of oxygen to inert gas ratios as is required in the decarburizing process.

It is understandable that gas consumption costs associated with the purchase of substantially pure nitrogen and oxygen in significantly large quantities to provide the decarburizing gas requirements for a steel making facility are significant.

Accordingly, a new and improved method of decarburizing molten steel is desired which adequately reduces the carbon content of the steel while reducing present gas consumption costs.

The present invention may be summarized as providing an improved method of decarburizing molten metal comprising the steps of injecting a mixture of oxygen and an inert gas into the molten metal while utilizing from about 2.5 to about 12% of the injected inert gas to shroud the remainder of the injected gaseous mixture. In the process of the present invention, the oxygen to inert gas ratio is progressively decreased as the carbon content in the molten metal decreases and the temperature of the molten metal increases. The improvement of the present invention comprises supplying dry air to the remainder of the injected gaseous mixture in a quantity sufficient for the nitrogen in the dry air to fulfill the inert gas requirements for the remainder of the injected gaseous mixture and for the oxygen in the dry air to fulfill at least a portion of the oxygen requirements for the injected gaseous mixture.

An objective of the present invention is to reduce gas consumption costs in the process for decarburizing metal, particularly steel.

An advantage of the present invention is the direct substitution of lower cost compressed air for gaseous nitrogen and gaseous oxygen from separate gas sources and the controlled utilization of such lower cost air in a decarburization process.

These and other objectives and advantages of this invention will be more fully understood and appreciated with reference to the following description.

DETAILED DESCRIPTION

As discussed above, decarburizing is a necessary and essential part of certain metal production processes, particularly the steel-making process. For example, in the production of certain steels, such as high chromium stainless steel, it is common for the initially melted hot metal to contain from about 0.5 to about 1.8% carbon. It may be necessary to reduce such carbon content to below about 0.06% and, for certain steel grades, below about 0.03% in order for the steel to be of acceptable quality. Although the present invention is described with particular reference to the production of steel, including stainless steel, it should be understood that the invention may apply to the decarburization of a variety of metals including silicon steel, carbon steel, tool steels, higher carbon containing ferrochromium, and other grades.

Reduction of the carbon content of a metal is performed by a decarburizing process. A typical decarburizing process, commonly called the argon-oxygen decarburization (AOD) process, includes injecting a mixture of gaseous oxygen and an inert gas into a vessel containing a molten metal bath. The inert gas may include nitrogen, argon, xenon, neon, helium or mixtures thereof. The injected gas mixture is introduced below the surface of the molten metal through one or a series of tuyeres preferably located at or near the bottom surface of the vessel.

During injection of the gaseous mixture into the molten metal, a portion of the inert gas, typically argon, is utilized to shroud the remainder of the injected mixture. Such shrouding protects the tuyeres and the vessel from the deleterious affects which the oxygen may otherwise have thereon during injection.

Such shrouding may be accomplished by using tuyeres constructed of two concentric pipes. A portion of the inert gas is supplied through the annulus, defined by the larger outside diameter pipe, into the vessel. The remainder of the gaseous mixture is supplied to the vessel through the central portion defined by the smaller diameter pipe. Although the inert gas requirements for the remainder of the gaseous mixture may be reduced by the process of the present invention as explained in detail below, it has been found that the inert gas requirements for providing the shroud should be maintained to prolong tuyere and refractory life. It has been found that the volume, or flow rate, of inert gas used to provide such shroud is typically from about 2.5 to about 12% of the total gas volume.

In the AOD process, the amount of gaseous oxygen and the amount of inert gas are controlled to accomplish the requisite carbon reduction. It is understandable that the desired carbon reduction may vary depending upon the metal being decarburized and the type of product to be produced therefrom. In a typical steel decarburization process, the temperature of the unrefined molten steel after being poured into an AOD vessel would be in the range of from 2400° to 2900° F., and more typically from 2600° to 2750° F. for most grades. Then a mixture of gaseous oxygen and inert gas from separate gas sources is injected below the surface of the molten steel at a high oxygen to inert gas ratio. Such oxygen injection is commonly called the "oxygen blow." It should be understood that the high oxygen to inert gas ratio is intended to include oxygen to inert gas ratios higher than about 2:1, and in certain applications may be as high as 7:1, although ratios of from 3:1 to 4:1 are most common. It should also be understood that reference to the phrase "decreasing the oxygen to inert gas ratio" means that the proportion of inert gas in the mixture increases with respect to the proportion of oxygen in such mixture.

During the oxygen blow at least a portion of the injected gaseous oxygen reacts with the carbon in the molten steel to evolve carbon oxides. It is understandable that the amount of oxygen must be sufficient with respect to the carbon content of the molten metal to evolve carbon oxides therefrom while the amount of oxygen must not be so excessive to cause oxidation of certain alloying elements particularly chromium. It has been found, accordingly, that a high oxygen to inert gas ratio of at least as high as about 2:1 is sufficient during the initial blowing stages. However, as is also understandable, as the carbon oxides evolve from the molten steel a lower oxygen concentration is required in the injected gas to continue decarburization while minimizing chromium loss. Therefore, the initial high oxygen to inert gas ratio should be reduced, typically to about 1:1, as the carbon content of the steel decreases, typically to less than about 0.5%. It is also typical that the temperature of the molten steel rises about 250° to 400° F. during such initial decarburization step to a temperature approximating 3000° F. The oxygen to inert gas ratio should be further reduced as the carbon content in the molten steel decreases. As discussed in detail below, it is typical that the oxygen to inert gas ratio is reduced to at least as low as about 1:3 as the carbon content in the molten steel decreases to less than about 0.2% and as the temperature of the molten steel increases another 100° F. to about 3100° F. Such finally reduced oxygen to inert gas ratio should thereafter be maintained until the carbon content in the molten steel is reduced to the desired level, which for most specialty steel grades is preferably below 0.06%.

The present invention may be applicable to decarburizing a variety of steel grades, even steel containing as high as about 30% chromium. It should be understood that the blowing schedules may have to be altered in instances of high chromium content in the molten steel primarily to prevent oxidation thereof.

As mentioned above, about 2.5 to 12% of the total gas volume should be utilized to maintain an inert gas shroud throughout the majority of the decarburizing process. The balance, or remainder, of the gaseous mixture comprises oxygen and an inert gas. For the purpose of this invention the term inert gas is used to refer to any gas which prevents the tuyere, or nozzle from oxidizing including nitrogen, argon, xenon, neon, helium and mixtures thereof.

In the past, all of the gases utilized for decarburizing were stored in separate facilities. Each gas was purchased in substantially pure form and segregated from the other gases until injection into a molten steel bath. It can be readily appreciated that the costs of manufacturing large quantities of commercially pure oxygen and nitrogen, typically by air liquefaction techniques may be significant. As such, the gas consumption costs in such prior art process comprise a significant portion of the overall decarburizing costs.

The present invention requires that the air substituted for gaseous nitrogen and that the substitution process itself be controlled in order for the substitution to be successful. In accordance with the the present invention, the air supplied for decarburizing molten metal must be dry. Dry air is supplied to the remainder of the injected gaseous mixture in a quantity sufficient for the nitrogen in the dry air to fulfill the inert gas requirements for the remainder of the injected gaseous mixture. As used in the present application, the term "dry air" means air which has been compressed to at least 200 psig, and preferably to about 250 psig, and is demoisturized to a dew point of −40° F. or lower. It should further be noted that the dry air of the present invention should not be compressed with oil or other lubricants which could contaminate the dry air.

The amount of inert gas required for maintaining a shroud may be established and maintained relatively uniform throughout the decarburizing process. The amount of inert gas required for the remainder of the gaseous mixture, i.e., apart from the shroud, is readily determined from the oxygen to total inert gas ratio. Then, an amount of dry air, as defined above, necessary to supply such inert gas (nitrogen) requirements is provided through the center of the injecting tuyere within the inert gas shroud and into the molten metal bath.

It follows, that a certain amount of oxygen is injected into the molten metal along with the nitrogen in the dry air. Such oxygen comprises about one-fifth of the total dry air injected. This amount of oxygen is usually not sufficient to satisfy all of the oxygen requirements, but the total oxygen requirements for that quantity which must be supplied from a separate source is reduced accordingly Thus, the substitution of dry air, as defined above, not only reduces separate source inert gas requirements but also reduces the separate source oxygen requirements.

Typically, the total gaseous nitrogen consumption during the decarburizing portion of the AOD refining process ranges from about 400 to about 1000 cubic feet per ton of steel. Such consumption may vary depending upon the amount of carbon and/or the amount of nitrogen tolerable in the final chemistry of the steel. Using such dry air, as set forth in the present invention, results in a replacement of at least 50%, and generally in excess of 80%, of the gaseous nitrogen formerly supplied as commercially pure gaseous nitrogen from a separate source. Such substitution of dry air further results in a replacement of, typically, about 25 to 35% of the oxygen requirements formerly supplied as commercially pure gaseous oxygen from a separate source. It will be appreciated that metal grades which have lower carbon tolerance require a longer oxygen blow. Also, certain metal grades permit a higher nitrogen content. In such instances the amount of dry air substituted for gaseous nitrogen and gaseous oxygen, and the corresponding savings resulting from which substitution may be more significant.

Table I below shows a comparison of gas consumption between conventional decarburization and decarburization in accordance with the present invention, for a 100-ton heat of Type 304 ELC (extra low carbon) stainless steel:

TABLE I:

| Oxygen:Inert Gas Ratio | Blow Time (Min.) | Oxygen Flow Rate (CFM) | Oxygen Volume (Cubic feet) | Nitrogen Flow Rate CFM | Nitrogen Volume (cubic feet) | Argon Flow Rate (CFM) | Argon Volume (cubic feet) | Air Flow Rate (CFM) | Air Volume (cubic feet) | TOTAL Volume (cubic feet) |
|---|---|---|---|---|---|---|---|---|---|---|
| DECARBURIZATION PROCESS | | | | | | | | | | |
| CONVENTIONAL | | | | | | | | | | |
| $30_2$:$1N_2$ | 14.2 | 2500 | 35,500 | 833 | 11,830 | 0 | 0 | 0 | 0 | 47,330 |
| $10_2$:$1N_2$ | 4.5 | 1667 | 7,500 | 1667 | 7,500 | 0 | 0 | 0 | 0 | 15,000 |
| $10_2$:$3N_2$ | 33.5 | 833 | 27,900 | 2500 | 83,750 | 0 | 0 | 0 | 0 | 111,650 |
| $10_2$:3Ar | 1.8 | 833 | 1,500 | 0 | 0 | 2500 | 4500 | 0 | 0 | 6,000 |
| TOTALS | 54.0 | | 72,400 | | 103,080 | | 4500 | | 0 | 179,980 |
| PRESENT INVENTION | | | | | | | | | | |
| $30_2$:$1N_2$ | 14.2 | 2342 | 33,260 | 200 | 2,840 | 0 | 0 | 789 | 11,230 | 47,330 |
| $10_2$:$1N_2$ | 4.5 | 1330 | 5,850 | 200 | 900 | 0 | 0 | 1833 | 8,250 | 15,000 |
| $10_2$:$3N_2$ | 33.5 | 258 | 8,640 | 200 | 6,700 | 0 | 0 | 2875 | 96,310 | 111,650 |
| $10_2$:3Ar | 1.8 | 833 | 1,500 | 0 | 0 | 2500 | 4500 | 0 | 0 | 6,000 |
| TOTALS | 54.0 | | 49,250 | | 10,440 | | 4500 | | 115,790 | 179,980 |
| SAVINGS IN GAS CONSUMPTION | | | 23,150 | | 92,640 | | | | | |

The consumption figures for argon and nitrogen, as set forth in Table I above, do not reflect gas consumption during stirring of a reduction mixture, or gas consumption during post refining operations which may be performed after decarburization. Typically, argon is used for stirring of a reduction mixture. Also, nitrogen may be consumed after decarburization in instances where there is an aimed nitrogen content for the molten metal.

Chemistry changes during the decarburization process, and through the reduction period of the present invention for the heat of Type 304 ELC stainless steel discussed above, are shown in Table II. The raw materials added during decarburization and for reduction after decarburization of such heat of Type 304 ELC stainless steel are shown in Table III.

TABLE II.

| Element | Percent by Weight: Hot Metal Chemistry | Adjusted Hot Metal Chemistry* | Reduction Chemistry |
|---|---|---|---|
| Carbon | .910 | 1.129 | .015 |
| Manganese | .85 | 1.76 | 1.70 |
| Silicon | .14 | .20 | .70 |
| Chromium | 17.29 | 17.76 | 18.60 |
| Nickel | 8.86 | 8.58 | 9.90 |
| Nitrogen | — | — | .06 |
| Iron | Bal. | Bal. | Bal. |

*Reflects chemistry after purposeful additions are made during decarburization.

TABLE III.

| Material | Pounds: During Decarburization | For Reduction |
|---|---|---|
| RAW MATERIAL ADDITIONS | | |
| High carbon chromium | 4261 | — |
| High carbon manganese | 2917 | — |
| Ferrochrome-silicon | — | 8523 |
| Electrolytic nickel | — | 3491 |
| Ferrosilicon | — | 35 |
| Lime | — | 7842 |

The carbon content and the molten metal temperatures at various stages of the above-described decarburization example are as follows:

TABLE IV.

| Stage | Percent Carbon | Temperature °F. |
|---|---|---|
| Start | 1.129 | 2600–2750 |
| End $30_2$:$1N_2$ | .40 | 3010 |
| End $10_2$:$1N_2$ | .25 | 3080 |
| End $10_2$:3 inert (Ar and $N_2$) | .015 | 3150 |

As illustrated in the above example, the amount of gaseous nitrogen utilized from a separate source when using the conventional decarburization process totals 103,080 cubic feet for the decarburization portion alone. However, when dry air, as defined above, is used for blowing, the gaseous nitrogen requirements are reduced to 10,440 cubic feet. It should be understood that such 10,440 cubic feet of gaseous nitrogen represents that quantity necessary to maintain an inert gas shroud during the major portion of the decarburization process. Also, the oxygen contained in the dry air results in a decrease in gaseous oxygen requirements. In particular, the gaseous oxygen consumed decreased from 72,400 cubic feet for conventional decarburizing to 49,250 cubic feet according to an exemplary process of the present invention.

It should be noted that in the above example the oxygen:nitrogen mixture is used for the first 98% of oxygen blowing requirements. For metal grades having low nitrogen contents such period may be significantly lower, however typically the mixture is used for the first 90–98% of oxygen blowing requirements. Thereafter, it may be considered necessary to substitute argon for the nitrogen in order to control the nitrogen content of the molten metal to a certain level, such as less than about 0.065% by weight. It should be apparent that such substitution may not be necessary in instances where nitrogen content is not critical.

Whereas the particular embodiments of this invention have been described above for purposes of illustration, it will be apparent to those skilled in the art that numerous variations of the details may be made without departing from the invention.

I claim:

1. An improved method of decarburizing molten metal comprising the steps of:

injecting a mixture of oxygen and an inert gas selected from the group consisting of nitrogen, argon, xenon, neon, helium, and mixtures thereof from separate gas sources into molten metal below the surface thereof, at a high oxygen to inert gas ratio of at least about 2:1, whereby a portion of the injected oxygen reacts with the carbon to evolve carbon oxides, during injection utilizing from about 2.5 to 12% of the injected inert gas to shroud the remainder of the injected gaseous mixture, progressively decreasing the oxygen to inert gas ratio as the carbon content in the molten metal decreases and as the temperature of the molten metal increases, and continuing injecting the gaseous mixture until the carbon content in the molten metal decreases to the desired level, wherein the improvement comprises:

while continuing to utilize from about 2.5 to 12% of the injected inert gas from a separate gas source to shroud the remainder of the injected gaseous mixture, supplying dry air to the remainder of the injected gaseous mixture in a quantity sufficient for the nitrogen in the dry air to fulfill the inert gas requirements for the remainder of the injected gaseous mixture, and for the oxygen in the dry air to fulfill a portion of the oxygen requirements for the remainder of the injected gaseous mixture, and reducing the volume of oxygen and inert gas injected from separate gas sources in accordance with the volume of oxygen and nitrogen injected with the supply of dry air to maintain the required oxygen to inert gas ratio.

2. An improved method of decarburizing molten metal comprising the steps of:

injecting a mixture of oxygen and an inert gas selected from the group consisting of nitrogen, argon, xenon, neon, helium, and mixtures thereof from separate gas sources into molten metal below the surface thereof, at an oxygen to inert gas ratio of at least as high as about 2:1, whereby a portion of the injected oxygen reacts with the carbon to evolve carbon oxides, during injection utilizing from about 2.5 to 12% of the injected inert gas to shroud the remainder of the injected gaseous mixture, progressively decreasing the oxygen to inert gas ratio of at least as low as about 1:2 as the carbon content in the molten metal decreases and as the temperature of the molten metal increases, and continuing injecting the gaseous mixture at an oxygen to inert gas ratio of at least as low as about 1:2 until the carbon content in the molten metal decreases to the desired level, wherein the improvement comprises:

while continuing to utilize from about 2.5 to 12% of the injected inert gas from a separate gas source to shroud the remainder of the injected gaseous mixture, supply dry air to the remainder of the injected gaseous mixture in a quantity sufficient for the nitrogen in the dry air to fulfill the inert gas requirements for the remainder of the injected gaseous mixture, and for the oxygen in the dry air to fulfill a portion of the oxygen requirements for the remainder of the injected gaseous mixture, and reducing the volume of oxygen and inert gas injected from separate gas sources in accordance with the volume of oxygen and nitrogen injected with the supply of dry air to maintain the required oxygen to inert gas ratio.

3. The method as set forth in claim 2 wherein the molten metal is steel.

4. The method as set forth in claim 2 wherein the molten metal is stainless steel.

5. The method as set forth in claim 2 wherein the molten metal is ferrochrome.

6. The method as set forth in claim 2 wherein the molten metal temperature at the start of decarburization is from about 2400° to 2900° F.

7. The method as set forth in claim 2 wherein the molten metal temperature at the start of decarburization is from about 2600° to 2750° F.

8. The method as set forth in claim 2 wherein an initial oxygen to inert gas ratio of about 3:1 is decreased to about 1:1 as the carbon content in the molten steel decreases to less than about 0.5%, and as the temperature of the molten steel increases to at least about 2900° F.

9. The method as set forth in claim 8 wherein the oxygen to inert gas ratio of 1:1 is further decreased to at least as low as about 1:3 as the carbon content in the molten steel decreases to less than about 0.2%, and as the temperature of the molten steel increases to at least about 3000° F.

10. The method as set forth in claim 9 wherein the oxygen to inert gas ratio of at least as low as about 1:3 is maintained until the carbon content in the molten steel decreases to less than about 0.1%.

11. The method as set forth in claim 9 wherein the oxygen to inert gas ratio of at least as low as about 1:3 is maintained until the carbon content in the molten steel decreases to less than about 0.06%.

12. An improved method of decarburizing chromium containing molten steel containing less than about 3.5% carbon, without substantial loss of chromium comprising the steps of:

injecting a mixture of oxygen and an inert gas selected from the group consisting of nitrogen, argon, xenon, neon, helium, and mixtures thereof from separate gase sources into molten steel maintained at a temperature of about 2600° F. to 2750° F., below the surface thereof, at an oxygen to inert gas ratio of about 3:1, whereby a portion of the injected oxygen reacts with the carbon to evolve carbon oxides, during injection utilizing from about 2.5 to 12% of the injected inert gas to shroud the remainder of the injected gaseous mixture, decreasing the oxygen to inert gas ratio to about 1:1 as the carbon content in the molten steel decreases to less than about 0.75%, and as the temperature of the molten steel increases to at least about 2900° F., further decreasing the oxygen to inert gas ratio to at least as low as about 1:3 as the carbon content in the molten steel decreases to less than about 0.2%, and as the temperature of the molten steel increases to at least about 3000° F., and continuing injecting the gaseous mixture at an oxygen to inert gas ratio of at least as low as about 1:3 until the carbon content in the molten steel decreases to less than about 0.10%, wherein the improvement comprises:

while continuing to utilize from about 2.5 to 12% of the injected inert gas from a separate gas source to shroud the remainder of the injected gaseous mixture, supplying dry air to the remainder of the injected gaseous mixture in a quantity sufficient for the nitrogen in the dry air to fulfill the inert gas requirements for the remainder of the injected gaseous mixture, and for the oxygen in the dry air to fulfill a portion of the oxygen requirements for the remainder of the injected gaseous mixture, and reducing the volume of oxygen and inert gas injected from separate gas sources in accordance with the volume of oxygen and nitrogen injected with the supply of dry air to maintain the required oxygen to inert gas ratio.

* * * * *